US007915511B2

(12) United States Patent
Korst et al.

(10) Patent No.: US 7,915,511 B2
(45) Date of Patent: Mar. 29, 2011

(54) METHOD AND ELECTRONIC DEVICE FOR ALIGNING A SONG WITH ITS LYRICS

(75) Inventors: Johannes Henricus Maria Korst, Eindhoven (NL); Gijs Geleijnse, Eindhoven (NL); Steffen Clarence Pauws, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 131 days.

(21) Appl. No.: 12/300,151

(22) PCT Filed: Apr. 27, 2007

(86) PCT No.: PCT/IB2007/051566

§ 371 (c)(1), (2), (4) Date: Nov. 10, 2008

(87) PCT Pub. No.: WO2007/129250

PCT Pub. Date: Nov. 15, 2007

(65) Prior Publication Data

US 2009/0120269 A1 May 14, 2009

(30) Foreign Application Priority Data

May 8, 2006 (EP) ..... 06113628

(51) Int. Cl.
*G04B 13/00* (2006.01)

(52) U.S. Cl. ..... 84/609; 84/610; 84/616; 84/649; 84/650; 84/654

(58) Field of Classification Search ..... None
See application file for complete search history.

(56) References Cited

U.S. PATENT DOCUMENTS

| | | | | |
|---|---|---|---|---|
| 6,582,235 | B1 | 6/2003 | Tsai et al. | |
| 2001/0042145 | A1 | 11/2001 | Frommer et al. | |
| 2002/0088336 | A1 | 7/2002 | Stahl | |
| 2004/0011188 | A1 | 1/2004 | Smith | |
| 2004/0266337 | A1 | 12/2004 | Radcliffe et al. | |
| 2006/0112812 | A1 * | 6/2006 | Venkataraman et al. | 84/616 |
| 2009/0120269 | A1 * | 5/2009 | Korst et al. | 84/609 |

(Continued)

FOREIGN PATENT DOCUMENTS

CA 2206922 A 12/1998

(Continued)

OTHER PUBLICATIONS

Wang et al.: "LyricAlly: Automatic Synchronization of Acoustic Musical Signals and Textual Lyrics" Proceedings of ACM Multimedia 2004 MM'04, Oct. 10, 2004, XP002449035.

(Continued)

*Primary Examiner* — Marlon T Fletcher

(57) ABSTRACT

A method of aligning a song with lyrics of the song which comprises the steps of aligning each lyrics fragment of a group of similar lyrics fragments (C) in the lyrics of the song with an audio fragment of a group of similar audio fragments ($A_4$) of the song and aligning each lyrics fragment of a further group of similar lyrics fragments ($V_2$) in the lyrics of the song with an audio fragment of a further group of similar audio fragments ($A_2$) of the song. The method can be performed by an electronic device, possibly enabled by a computer program product. A mapping determined with the method can be transmitted and received by means of a signal and/or stored in a database.

9 Claims, 2 Drawing Sheets

U.S. PATENT DOCUMENTS

| | | | | |
|---|---|---|---|---|
| 2009/0217805 | A1* | 9/2009 | Lee et al. | 84/611 |
| 2009/0314155 | A1* | 12/2009 | Qian et al. | 84/622 |

FOREIGN PATENT DOCUMENTS

| | | | |
|---|---|---|---|
| EP | 0493648 | A1 | 7/1992 |
| WO | 2005050888 | A2 | 6/2005 |

OTHER PUBLICATIONS

Kai Chen, et al: "Popular Song and Lyrics Synchronization and Its Application to Music Information Retrieval" Proceedings of SPIE-IS&T, vol. 6071, 2005, XP002449036.

Peter Knees et al: "multiple lyrics alignment: automatic retrieval of song lyrics" Proceedings Annual International Symposium on Music Information Retrieval, Sep. 30, 2005, pp. 564-569, XP002423234.

Goto et al.: "Automatic synchronization between lyrics and music CD recordings based on Viterbi alignment of segregated vocal signals" 2006 8th IEEE International Symposium on Multimedia, San Diego, CA, USA, Dec. 13, 2006, p. 8, XP002449039 ISBN: 0-7695-2746-9.

Korst, J. et al.: "Efficient Lyrics Retrieval and Alignment" Proceedings of the Third Philips Symposium on Intelligent Algorithms, Dec. 7, 2006, XP002449037 Eindhoven, The Netherlands.

Wong, Chi Hang, et al: Automatic Lyrics Alignment on Popular Music, Proceedings of the ISCA 20th Int'l Conf. Computers and Their Applications, 2005, Abstract.

* cited by examiner

METHOD AND ELECTRONIC DEVICE FOR ALIGNING A SONG WITH ITS LYRICS

The invention relates to a method of aligning a song with its lyrics.

The invention further relates to an electronic device for aligning a song with its lyrics.

The invention also relates to a computer program product comprising software for enabling a programmable device to perform a method of aligning a song with its lyrics.

The invention further relates to a database comprising a mapping between audio and lyrics fragments of a song.

The invention also relates to a signal comprising a mapping between audio and lyrics fragments of a song.

An embodiment of this method is known from the article "LyricAlly: Automatic Synchronization of Acoustic Musical Signals and Textual Lyrics" by Ye Wang et al (ACM MM'04, Oct. 10-16, 2004, New York, USA). This article proposes a multi-modal approach to automating alignment of textual lyrics with acoustic music signals. It proposes incorporating modules for music understanding in terms of rhythm, chorus detection and singing voice detection and leveraging text processing to add constraints to the audio processing, pruning unnecessary computation and creating rough estimates for duration, which are refined by the audio processing. It is a disadvantage of the known method that it only works with songs having a specific structure.

It is a first object of the invention to provide an electronic device of the type described in the opening paragraph, which can work with songs having an unknown structure.

It is a second object of the invention to provide a method of the type described in the opening paragraph, which can be used with songs having an unknown structure.

According to the invention, the first object is realized in that the electronic circuitry is configured to align each lyrics fragment of a group of similar lyrics fragments in lyrics of a song with an audio fragment of a group of similar audio fragments of the song and align each lyrics fragment of a further group of similar lyrics fragments in the lyrics of the song with an audio fragment of a further group of similar audio fragments of the song. The inventors have recognized that, if the structure of a song is unknown, it is not sufficient to consider non-chorus lyrics fragments as independent, because this would make the number of solutions to the mathematical problem of mapping lyrics fragments to audio fragments too large, especially because of the existence of instrumental audio fragments.

The method of the invention may be used, for example, to display a lyrics fragment while the corresponding audio fragment is being played back. Alternatively, the method of the invention may be a first step in creating an automatic phrase-by-phrase, word-by-word, or syllable-by-syllable alignment of song and lyrics. The lyrics of a song may be retrieved from, for example, the Internet. Aligning the lyrics fragments with the audio fragments may comprise creating a mapping between the lyrics fragments and the audio fragments and/or playing back the song in accordance with this mapping.

In an embodiment of the electronic device of the invention, the group and/or the further group of similar lyrics fragments have been determined by comparing an amount of syllables per lyrics fragment, an amount of syllables per line and/or a rhyme scheme of lyrics fragments in the lyrics of the song. These three features, and especially the amount of syllables per line, give an accurate measure of verse similarity. Choruses can be determined by looking for lyrics fragments with a high word repetition between them.

The group and/or the further group of similar audio fragments may have been determined by means of harmonic progression analysis. Harmonic progression analysis has proved to work well in experiments.

According to the invention, the second object is realized in that the method comprises the steps of aligning each lyrics fragment of a group of similar lyrics fragments in the lyrics of the song with an audio fragment of a group of similar audio fragments of the song and aligning each lyrics fragment of a further group of similar lyrics fragments in the lyrics of the song with an audio fragment of a further group of similar audio fragments of the song.

In an embodiment of the method of the invention, the group and/or the further group of similar lyrics fragments have been determined by comparing an amount of syllables per lyrics fragment, an amount of syllables per line and/or a rhyme scheme of lyrics fragments in the lyrics of the song.

The group and/or the further group of similar audio fragments may have been determined by means of harmonic progression analysis.

These and other aspects of the invention are apparent from and will be further elucidated, by way of example, with reference to the drawings, in which.

Corresponding elements in the drawings are denoted by the same reference numerals.

Figure 1:
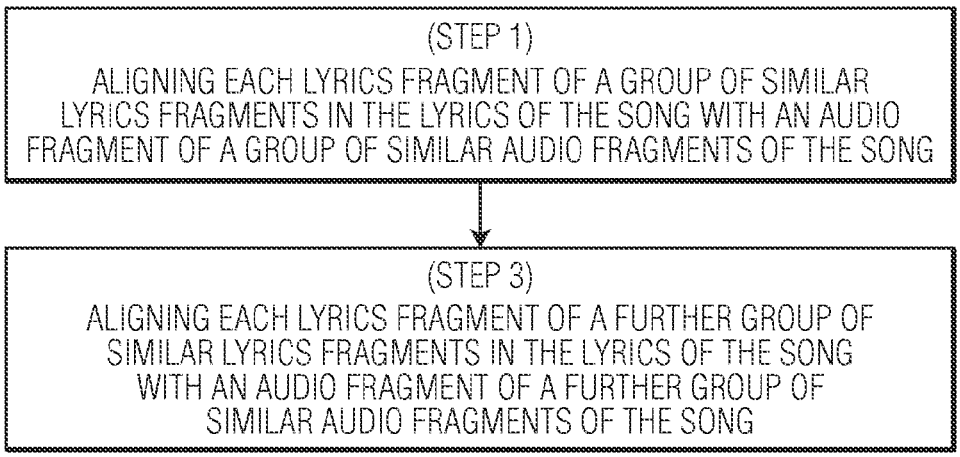
FIG. 1 is a flow diagram of the method of the invention.

The method of aligning a song with its lyrics comprises a step 1 and a step 3, see FIG. 1. Step 1 comprises aligning each lyrics fragment of a group of similar lyrics fragments in the lyrics of the song with an audio fragment of a group of similar audio fragments of the song. Step 3 comprises aligning each lyrics fragment of a further group of similar lyrics fragments in the lyrics of the song with an audio fragment of a further group of similar audio fragments of the song.

The group and/or the further group of similar lyrics fragments may be determined by comparing an amount of syllables per lyrics fragment (e.g. 30), an amount of syllables per line (e.g. 3,10,9,4,4 for a certain lyrics fragment of five lines) and/or a rhyme scheme of lyrics fragments in the lyrics of the song. The group and/or the further group of similar audio fragments may be determined by means of harmonic progression analysis.

Figure 2:
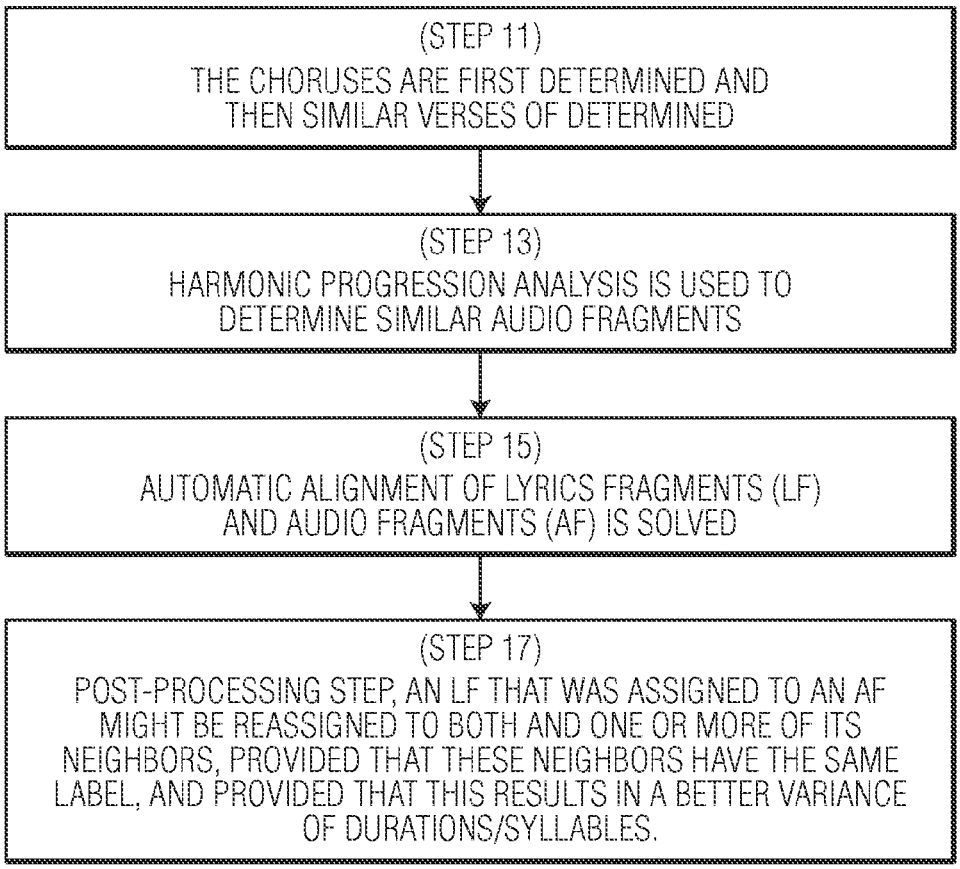
FIG. 2 is a flow diagram of an embodiment of the method of the invention.

An embodiment of the method, see FIG. 2, comprises four steps: a step 11 of determining a group and a further group of similar lyrics fragments in the lyrics of the song, a step 13 of determining a group and a further group of similar audio fragments of the song, a step 15 of mapping lyrics fragments to audio fragments and a step 17 of playing back the lyrics fragments and the song based on the mapping. Either step 15 or step 17 or both may be considered as aligning lyrics fragments in the lyrics of the song with audio fragments of the song.

In an implementation of step 11, the choruses are first determined and then similar verses are determined. The following techniques can be used to determine choruses:

1. determine the part of the lyrics that is (almost) identically repeated.
2. determine the fragment in which the song title is mentioned.
3. determine the self-similarity of each fragment.

Typically, the chorus of a song is the part of the lyrics that is identically repeated; it contains the song title, and it contains more repetitions than a verse. Given certain lyrics, some preprocessing can be done to distinguish the actual lyrics (the part that is actually sung) from annotations. Some annotations (e.g. specifying who is singing, who made the music) can just be filtered out, as they are not relevant for synchronizing lyrics with the audio. Other annotations (e.g. "chorus", "repeat two times", etc.) result in expanding parts of the lyrics, such that each time the chorus is sung, it appears in the lyrics.

Subsequently, a distinction can be made between fragmented lyrics and non-fragmented ones. Fragmented lyrics consist of multiple fragments, wherein blank lines separate the fragments. Typically, the fragments relate to a verse, a chorus, an intro, a bridge, etc. If the lyrics are already fragmented, it is assumed that the chorus is given by a complete one of these fragments. If the lyrics are fragmented, the following steps can be performed.

1. First, it is determined for each fragment whether or not it contains the song title (exactly or approximately). Looking for approximate occurrences of the song title can be helpful if, for example, the song title is "I love U", while the lyrics say "I love you". There are all sorts of small variations possible. To account for these small variations, approximate matching techniques can be applied.
2. Secondly, it is determined for each pair of fragments how well they resemble. To this end, an optimal alignment is determined for each pair of fragments. An optimal alignment is an alignment that matches a maximum number of characters in one fragment to characters in the other fragment, by allowing insertions of spaces in either of the fragments and by allowing mismatches. An optimal alignment relates to converting one fragment into the other by using a minimal number of insertions, deletions, and replacements. Such an optimal alignment can be constructed by dynamic programming in O(nm) time, wherein n and m are the lengths of the two fragments.
3. Thirdly, the amount of repetition within each fragment is determined. This can be carried out as follows. First, the substrings that are identically repeated within a fragment are determined. The substrings that cannot be enlarged are identified. Such substrings are known as maximum extents. Let 'the more I want you' be such a maximum extent, then two occurrences of this substring will be preceded by different characters and they will be succeeded by different characters (otherwise it would not be a maximum extent). subsequently, all occurrences (except for the first one) of the maximum extent of the maximum size are repeatedly replaced by a unique word (e.g. r#1, r#2 etc.) that does not already occur in the fragment. This is repeated until no maximum extents remain.

The fraction of the length of the resulting string, divided by the length of the original string is used as a measure of the repetition within the fragment. Using the above three measures, the fragment that is probably the chorus is selected.

If the lyrics are not already partitioned into fragments, similar indications are still used, if possible, to identify the chorus. Again by using dynamic programming, parts of the lyrics that are almost identically repeated can be found. In this case, it is assumed that the chorus consists of a sequence of complete lines. A local alignment dynamic programming algorithm can be adapted in such a way that only sequences of complete lines are considered. This can be computed in O(n^2) time, wherein n is the length of the lyrics. Given one or more parts that are more or less identically repeated, the lyrics are automatically partitioned into fragments.

After the choruses have been determined, additional clues can be used to find potential borders between fragments. For example, if two successive lines rhyme, they probably belong to the same fragment. In addition, the number of phonemes can be counted. The resulting fragments should preferably show a repeating pattern of numbers of phonemes per fragment.

In an implementation of step 13, harmonic progression analysis is used to determine similar audio fragments. To this end, the chroma spectrum is computed for equidistant intervals. For best performances, the interval should be a single bar in the music. For locating the bar, one needs to know the meter, the global tempo, and down-beat of the music. The chroma spectrum represents the likelihood scores of all twelve pitch classes. These spectra can be mapped onto a chord symbol (or the most likely key) which allows transformation of the audio into a sequence of discrete chord symbols. Using standard approximate pattern matching, similar sub-sequences can be grouped into clusters and tagged with a name.

In an implementation of step 15, the problem of automatic alignment of lyrics fragments (LF) and audio fragments (AF) is solved by means of the following method.

Suppose, for a given song, that there are n LFs, numbered 1,2, . . . , n, and m AFs, numbered 1,2, . . . , m, wherein usually n<m. Furthermore, let the label of LF i be denoted by 1(i), and with minor abuse of notation, let the label of AF j be denoted by 1(j). To find an alignment, a search approach can be used, using a search tree that generates all order-preserving and consistent assignments of LFs to AFs.

An assignment is a mapping a: {1,2, . . . , n}->{1,2, . . . , m} that assigns each LF to exactly one AF. An assignment is order-preserving if for each LF in {1,2, . . . , n−1} we have a(i)<=a(i+1). An assignment is called consistent if identically labeled LFs are assigned to identically labeled AFs, i.e. if for each pair i,j of LFs 1(i)=1(j)=>1(a(i))=1(a(j)). Occasionally, no consistent assignment exists. In that case, an assignment with a minimum number of inconsistencies is selected.

Very often, the number of order-preserving and consistent assignments can be quite large, sometimes even a few thousand assignments. Note that it may be necessary to assign successive LFs to the same AF, but the correct assignment almost always has the property that it has a maximum range, i.e. the set of AFs to which the LFs are assigned is of maximum cardinality. The subset of maximum-range assignments is usually considerably smaller than the complete set of order-preserving and consistent solutions. The resulting subset usually consists of less than 10 solutions.

Finally, the variance in {d(a(1))/s(1), d(a(2))/s(2), . . . , d(a(n))/s(n)} is considered for each of the remaining solutions, wherein, for an AF j, d(j) denotes the duration of the audio fragment and, for an LF i, s(i) denotes the number of syllables in the lyrics fragment. The assumption is that the solution with the minimum variance corresponds to the correct assignment.

Further clues are:

The first audio fragment is usually instrumental (especially if it is relatively short).

If multiple audio fragments do not get a lyrics fragment assigned to it, then these should preferably have the same label.

As post-processing step, an LF i that was assigned to an AF j might be reassigned to both j and one or more of its neighbors, provided that these neighbors have the same label as j, and provided that this results in a better variance of durations/syllables.

Figure 3:
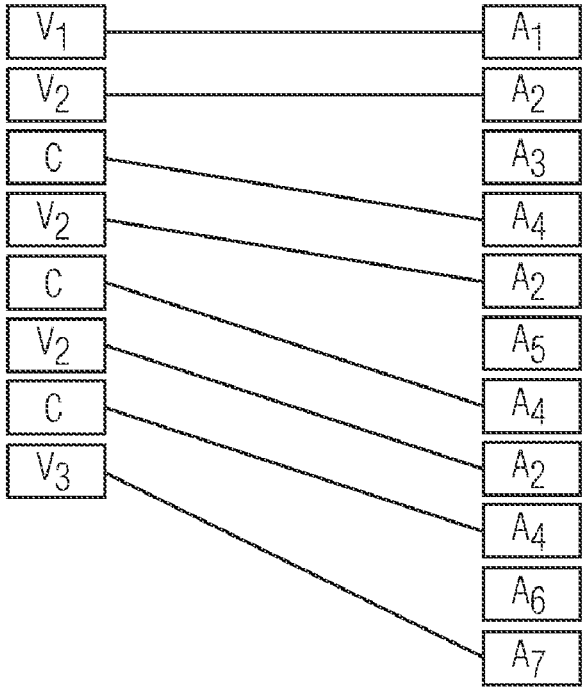
FIG. 3 is an example of a mapping created by means of the method of the invention.

FIG. 3 shows an example of an assignment of Lyrics Fragments (LF) to Audio Fragments (AF). The Audio Fragments are labeled $A_1$ to $A_7$ of which $A_2$ and $A_4$ are groups of similar Audio Fragments. The Lyrics Fragments are labeled $V_1$ to $V_3$ (for the verses) and C (for the choruses) of which $V_2$ and C are groups of similar Lyrics Fragments. Each lyrics fragment of group $V_2$ is mapped to an audio fragment of group $A_2$ and each lyrics fragment of group C is mapped to an audio fragment of group $A_4$. In this example, a distinction is made between choruses and verses, but this is not required. If the lyrics contain explicit indications of instrumental parts such as a bridge or a solo, these can be identified as lyrics fragments and used in performing the assignment. The resulting lyrics label sequence may also be helpful in analyzing the music. If, on the basis of analyzing the lyrics, the global structure of the song is known, it will be easier to identify the various parts in the audio signal.

Figure 4:
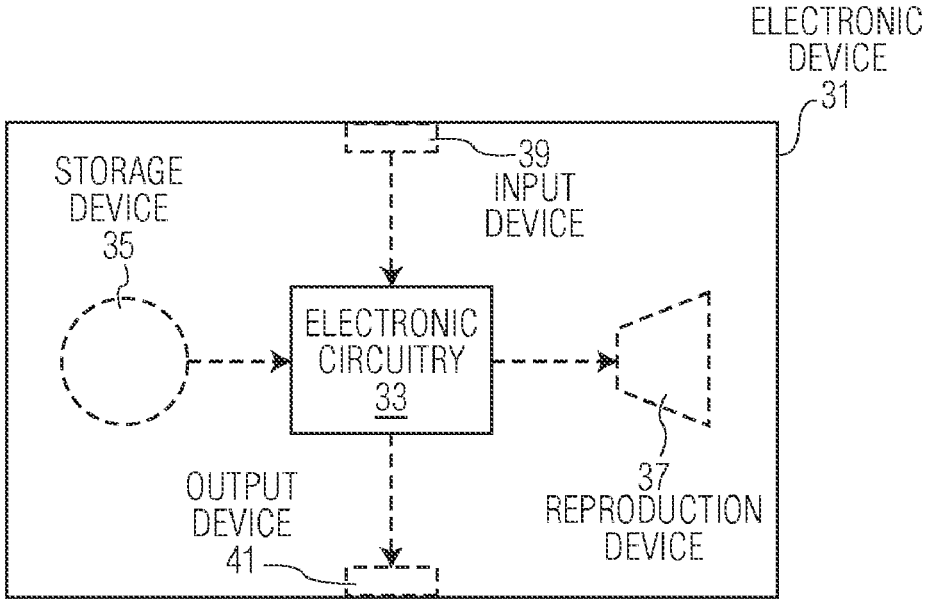
FIG. 4 is a block diagram of the electronic device of the invention.

FIG. 4 shows the electronic device 31 of the invention. The electronic device 31 comprises electronic circuitry 33 configured to align each lyrics fragment of a group of similar lyrics fragments in the lyrics of a song with an audio fragment of a group of similar audio fragments of the song and align each lyrics fragment of a further group of similar lyrics fragments in the lyrics of the song with an audio fragment of a further group of similar audio fragments of the song. The electronic device 31 may further comprise a storage means 35, a reproduction means 37, an input 39 and/or an output 41. The electronic device 31 may be a professional device or a consumer device, for example, a stationary or portable music player. The electronic circuitry 33 may be a general-purpose or an application-specific processor and may be capable of executing a computer program.

The storage means 35 may comprise, for example, a hard disk, a solid-state memory, an optical disc reader or a holographic storage means. The storage means 35 may comprise a database with at least one mapping between audio and lyrics fragments of a song. The reproduction means 37 may comprise, for example, a display and/or a loudspeaker. The aligned song and lyrics fragments may be reproduced via the reproduction means 37.

Alternatively, the output 41 may be used to display the lyrics fragments on an external display (not shown) and/or to play the audio fragments on an external loudspeaker (not shown). The input 39 and output 41 may comprise, for example, a network connector, e.g. a USB connecter or an Ethernet connector, an analog audio and/or video connector, such as a cinch connector or a SCART connector, or a digital audio and/or video connector, such as a HDMI or SPDIF connector. The input 39 and output 41 may comprise a wireless receiver and/or a transmitter. The input 39 and/or the output 41 may be used to receive and transmit, respectively, a signal comprising a mapping between audio and lyrics fragments of a song.

While the invention has been described in connection with preferred embodiments, it will be understood that modifications thereof within the principles outlined above will be evident to those skilled in the art, and thus the invention is not limited to the preferred embodiments but is intended to encompass such modifications. The invention resides in each and every novel characteristic feature and each and every combination of characteristic features. Reference numerals in the claims do not limit their protective scope. Use of the verb "to comprise" and its conjugations does not exclude the presence of elements other than those stated in the claims. Use of the article "a" or "an" preceding an element does not exclude the presence of a plurality of such elements.

The invention can be implemented by means of hardware comprising several distinct elements, and by means of a suitably programmed computer. 'Computer program product' is to be understood to mean any software product stored on a computer-readable medium, such as a floppy disk, downloadable via a network, such as the Internet, or marketable in any other manner.

The invention claimed is:

1. An electronic device comprising electronic circuitry for use in aligning a song with its lyrics and configured to:

input the song and its lyrics;

determine a group of similar ones of lyric fragments partitioning a song by determining how well fragments resemble each other; and align each lyrics fragment of the group of similar ones of the lyrics fragments with an audio fragment of a group of similar audio fragments of the song, characterized in that the determination includes determining a further group of similar ones of the lyrics fragments, and in that the electronic circuitry is configured to align each lyrics fragment of the further group of similar ones of the lyrics fragments in the lyrics of the song with an audio fragment of a further group of similar audio fragments of the song.

2. An electronic device as claimed in claim 1, wherein the group and/or the further group of similar lyrics fragments have been determined by comparing an amount of syllables per lyrics fragment, an amount of syllables per line and/or a rhyme scheme of lyrics fragments in the lyrics of the song.

3. An electronic device as claimed in claim 1, wherein the group and/or the further group of similar audio fragments have been determined by means of harmonic progression analysis.

4. A method of aligning a song with its lyrics, the method comprising the steps of:

inputting the song and its lyrics;

determining a group of similar ones of lyric fragments partitioning a song by determining how well fragments resemble each other; and aligning each lyrics fragment of the group of similar ones of the lyrics fragments with an audio fragment of a group of similar audio fragments of the song, characterized in that the determination includes determining a further group of similar ones of the lyrics fragments, and by aligning each lyrics fragment of the further group of similar ones of the lyrics fragments with an audio fragment of a further group of similar audio fragments of the song.

5. A method as claimed in claim 4, wherein the group and/or the further group of similar lyrics fragments have been determined by comparing an amount of syllables per lyrics fragment, an amount of syllables per line and/or a rhyme scheme of lyrics fragments in the lyrics of the song.

6. A method as claimed in claim 4, wherein the group and/or the further group of similar audio fragments have been determined by means of harmonic progression analysis.

7. A computer program product comprising software for enabling a programmable device to perform the method of claim 4.

8. A database comprising a mapping between audio and lyrics fragments of a song, wherein the mapping has been created by means of the method of claim 4.

9. A signal comprising a mapping between audio and lyrics fragments of a song of the song, wherein the mapping has been created by means of the method of claim 4.

* * * * *